US009903143B2

(12) United States Patent
Hiramoto

(10) Patent No.: US 9,903,143 B2
(45) Date of Patent: Feb. 27, 2018

(54) SWITCH ASSEMBLY OF VEHICLE DOOR LATCH DEVICE

(71) Applicant: MITSUI KINZOKU ACT CORPORATION, Kanagawa (JP)

(72) Inventor: Shigenori Hiramoto, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 516 days.

(21) Appl. No.: 14/584,433

(22) Filed: Dec. 29, 2014

(65) Prior Publication Data

US 2016/0060914 A1 Mar. 3, 2016

(30) Foreign Application Priority Data

Sep. 2, 2014 (JP) ..... 2014-178597

(51) Int. Cl.

| | |
|---|---|
| ***E05B 85/20*** | (2014.01) |
| ***E05B 81/20*** | (2014.01) |
| ***E05B 81/66*** | (2014.01) |
| ***E05B 81/68*** | (2014.01) |
| *E05B 81/14* | (2014.01) |

(52) U.S. Cl.

CPC ..... *E05B 81/20* (2013.01); *E05B 81/66* (2013.01); *E05B 81/68* (2013.01); *E05B 81/14* (2013.01)

(58) Field of Classification Search

CPC ..... E05B 81/20; E05B 81/68; E05B 81/66; E05B 81/14

See application file for complete search history.

(56) References Cited

U.S. PATENT DOCUMENTS

| | | | | |
|---|---|---|---|---|
| 6,659,515 | B2 * | 12/2003 | Raymond | E05B 81/20 292/201 |
| 6,698,804 | B2 | 3/2004 | Shiota et al. | |
| 9,290,969 | B2 | 3/2016 | Yokota et al. | |
| 9,428,943 | B2 * | 8/2016 | Mitchell | E05B 77/06 |
| 2010/0117379 | A1 | 5/2010 | Mitchell et al. | |

FOREIGN PATENT DOCUMENTS

| | | | |
|---|---|---|---|
| CN | 101109246 | A | 1/2008 |
| CN | 103075054 | A | 5/2013 |
| JP | 2014-009477 | A | 1/2014 |

OTHER PUBLICATIONS

Office Action issued in corresponding Chinese Patent Application No. 201410815911, dated Jul. 14, 2017.

* cited by examiner

*Primary Examiner* — Matthieu F Setliff
*Assistant Examiner* — Thomas L Neubauer
(74) *Attorney, Agent, or Firm* — McDermott Will & Emery LLP

(57) ABSTRACT

A switch assembly of a vehicle door latch device, the switch assembly includes: a latch switch detecting a position of a latch, the latch being pivotally supported by a latch shaft to be engaged with a striker; a ratchet switch that detecting a position of a ratchet, the ratchet being pivotally supported by a ratchet shaft to be engaged with the latch and prevented reverse rotation of the latch; and a one common switch case that the latch switch and the ratchet switch are installed in the one common switch case. The latch shaft and the ratchet shaft are arranged to be isolated across a striker moving trajectory of the striker. The one common switch case is arranged on a latch body on one side of a striker moving trajectory.

4 Claims, 7 Drawing Sheets

SWITCH ASSEMBLY OF VEHICLE DOOR LATCH DEVICE

CROSS-REFERENCE TO RELATED APPLICATIONS

The present application claims priority to and incorporates by reference the entire contents of Japanese Patent Application No. 2014-178597 filed in Japan on Sep. 2, 2014.

BACKGROUND OF THE INVENTION

1. Field of the Invention

The present invention relates to a vehicle door latch device, and in particular, to a switch assembly that detects positions of a latch and a ratchet of the latch device.

2. Description of the Related Art

FIG. 7 illustrates a front face of a conventionally well known vehicle door latch device (latch unit), and onto a latch body A of the latch device, the latch body A being formed of a synthetic resin or the like, a latch C is pivotally supported by a latch shaft B and a ratchet E is pivotally supported by a ratchet shaft D. When a door moves to be closed, a striker F fixed to the body of the vehicle relatively advances into an advancement passage G formed in the latch body A, engages with an engagement groove H of the latch C, and rotates the latch C at an unlatched position in a full latch direction (clockwise direction). When the latch C is brought to a half latch position, the ratchet E is rotated by a spring elastic force in the clockwise direction and becomes engageable with a half latch engagement portion J of the latch C; when the latch C comes to a full latch position, the ratchet E becomes engageable with a full latch engagement portion K of the latch C; and when the ratchet E engages with the full latch engagement portion K of the latch C, the door closure operation is complete and the door is maintained in a closed state.

Further, a conventional latch unit is sometimes provided with an automatic closer function for rotating the latch C at the half latch position towards the full latch position by a motor power and an automatic releasing function for rotating a ratchet E by a motor power in a door opening direction (anticlockwise direction in FIG. 7) to separate the ratchet E from the full latch engagement portion K of the latch C and bring the door into an openable state (see, for example, Japanese Patent Application Laid-open No. 2014-009477). In this case, the latch unit is provided with a latch switch L that detects a position of the latch C and a ratchet switch M that detects a position of the ratchet E, and the automatic closer function and the automatic releasing function are controlled by signals from these switches being used.

In the latch unit illustrated in FIG. 7, the latch C (latch shaft B) and the ratchet E (ratchet shaft D) are respectively arranged separately, on a rear face side of the latch body A, to an upper side (latch side) and to a lower side (ratchet side) in the figure, of the advancement passage G of the striker (striker moving trajectory). With such an arrangement relation, an external force added from the striker F to the latch C is dispersed between and supported by the two shafts B and D above and below. In the industry, this arrangement structure is called "reaction force halving structure", and this "reaction force halving structure" is the mainstream of the arrangement relation between a latch and a ratchet.

In a latch unit employing the "reaction force halving structure", the latch switch L and the ratchet switch M are also respectively arranged separately to the latch side and the ratchet side divided by the advancement passage G, on the rear face side of the latch body A. Accordingly, two switch assemblies thus needing to be separately prepared and more than one step being required in the installation operation have been cost increasing factors.

SUMMARY OF THE INVENTION

It is an object of the present invention to at least partially solve the problems in the conventional technology.

According to one aspect of the present invention, there is provided a switch assembly of a vehicle door latch device, the switch assembly including: a latch switch detecting a position of a latch, the latch being pivotally supported by a latch shaft to be engaged with a striker, the latch shaft being mounted on a latch body, the latch body including an advancement passage into which the striker relatively advances upon door closure; a ratchet switch that detecting a position of a ratchet, the ratchet being pivotally supported by a ratchet shaft to be engaged with the latch and prevented reverse rotation of the latch, the ratchet shaft being mounted on the latch body; and a one common switch case that the latch switch and the ratchet switch are installed in the one common switch case, wherein the latch and the ratchet are arranged on a front face side of the latch body, the latch shaft and the ratchet shaft are arranged to be isolated across a striker moving trajectory of the striker, and the common switch case is arranged on the latch body on one side of the striker moving trajectory.

The switch assembly according to another aspect of the present invention may include a latch switch lever that rotates in association with the latch and includes a cam surface that comes into contact with a movable terminal of the latch switch. The latch switch lever is arranged on the rear face of the latch body, and the movable terminal and the cam surface are configured to come into contact with each other at a position where the movable terminal and the cam surface overlap with a back face side bulged portion of the latch body, the back face side bulged portion zoning the advancement passage.

The switch case according to still another aspect of the present invention may be configured to not overlap with the back face side bulged portion of the latch body, the back face side bulged portion zoning the advancement passage.

The switch case according to further another aspect of the present invention may be configured to not overlap with the back face side bulged portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
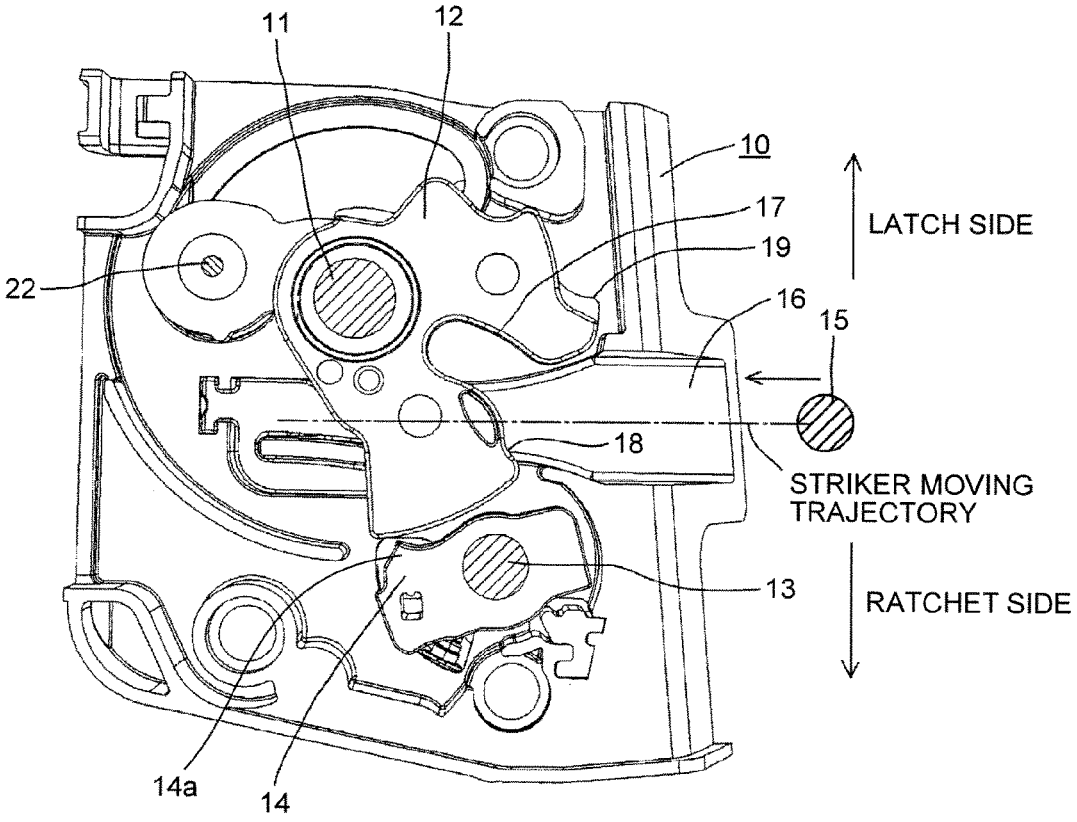
FIG. 1 is a front view of a latch unit of a door latch device to which a switch assembly, which is an embodiment of the present invention, is applied.

An embodiment of the present invention will be described. The gist of the present invention is in a switch assembly including a latch switch and a ratchet switch. A configuration of a latch unit itself may be the same as the conventional one. As illustrated in FIG. 1, onto a latch body 10 of the latch unit (latch device), the latch body 10 being formed of a synthetic resin or the like, a latch 12 is pivotally supported by a latch shaft 11 and a ratchet 14 is pivotally supported by a ratchet shaft 13. The latch 12 has an engagement groove 17, a half latch engagement portion 18, and a full latch engagement portion 19. The engagement groove 17 is formed from an outer peripheral surface of the latch 12 towards the latch shaft 11 and has a width that is able to accommodate a striker 15. The half latch engagement portion 18 is formed, as illustrated in FIG. 1, at a portion positioned on a left side of an opening edge portion of the latch 12 in the engagement groove 17. This half latch engagement portion 18 is configured to lock the latch 12 by engaging with the ratchet 14 when the latch 12 is caused to be rotated in a clockwise direction and brought to a half latch position. The full latch engagement portion 19 is formed as a concave portion on the outer peripheral surface of the latch 12. This full latch engagement portion 19 is configured to lock the latch 12 by engaging with the ratchet 14 when the latch 12 is rotated in the clockwise direction and brought to a full latch position.

The ratchet 14 has a claw part 14*a*. The claw part 14*a* is formed so as to protrude towards the latch 12, at a radial direction end portion of the ratchet 14. The ratchet 14 is engageable with the half latch engagement portion 18 and the full latch engagement portion 19 of the latch 12 via that protruded portion when the ratchet 14 is rotated in the clockwise direction. The ratchet 14 is continuously biased in the clockwise direction by a spring elastic force.

When a door moves to be closed, the striker 15 fixed to a vehicle body relatively advances into an advancement passage 16 formed in the latch body 10, engages with the engagement groove 17 of the latch 12, and causes the latch 12 at an unlatched position to be rotated in the full latch direction (clockwise direction). When the latch 12 is brought to the half latch position, the ratchet 14 is rotated in the clockwise direction by the spring elastic force and the claw part 14*a* and the half latch engagement portion 18 of the latch 12 become engageable with each other. Further, when the latch 12 is brought to the full latch position, the claw part 14*a* and the full latch engagement portion 19 of the latch 12 become engageable with each other. When the claw part 14*a* of the ratchet 14 engages with the full latch engagement portion 19 of the latch 12, the door closing operation is complete and the door is maintained in a closed state.

Figure 3:
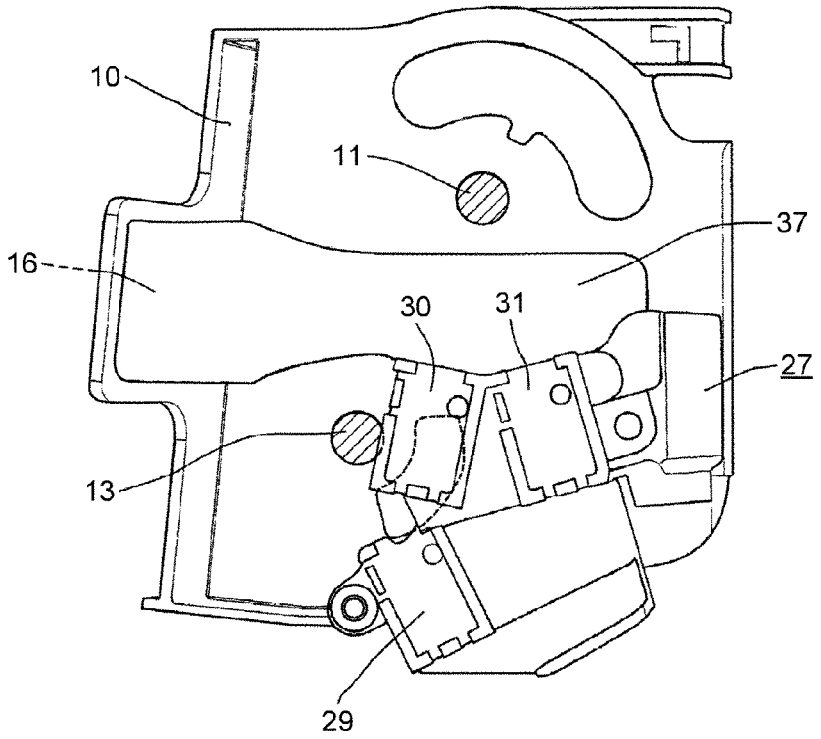
FIG. 3 is a schematic diagram illustrating an arrangement position of a switch case with respect to a latch body of the latch unit.
Figure 4:
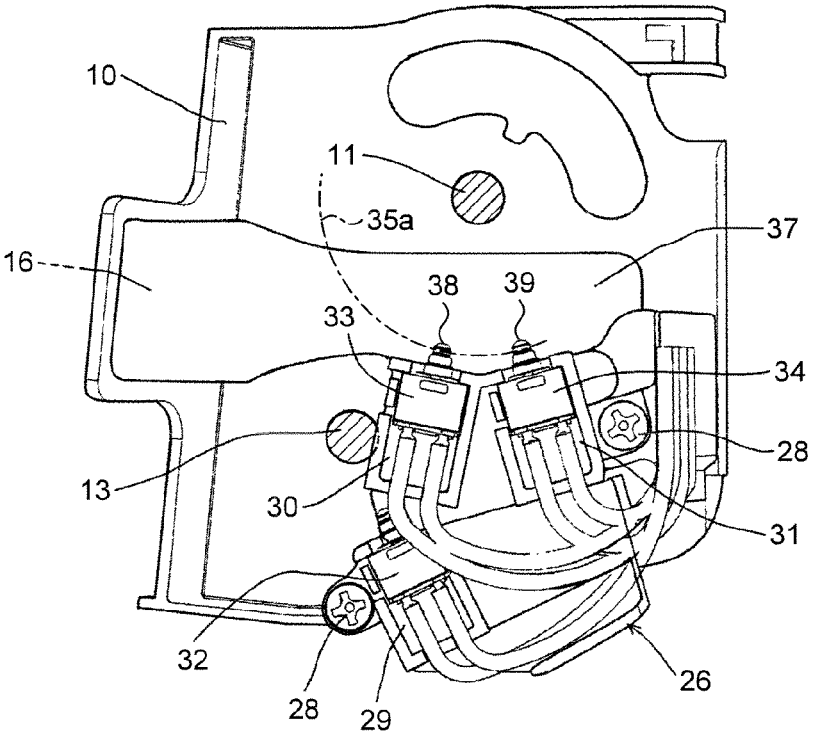
FIG. 4 is a schematic diagram illustrating a state where three switches have been installed in the switch case of FIG. 3.
Figure 7:
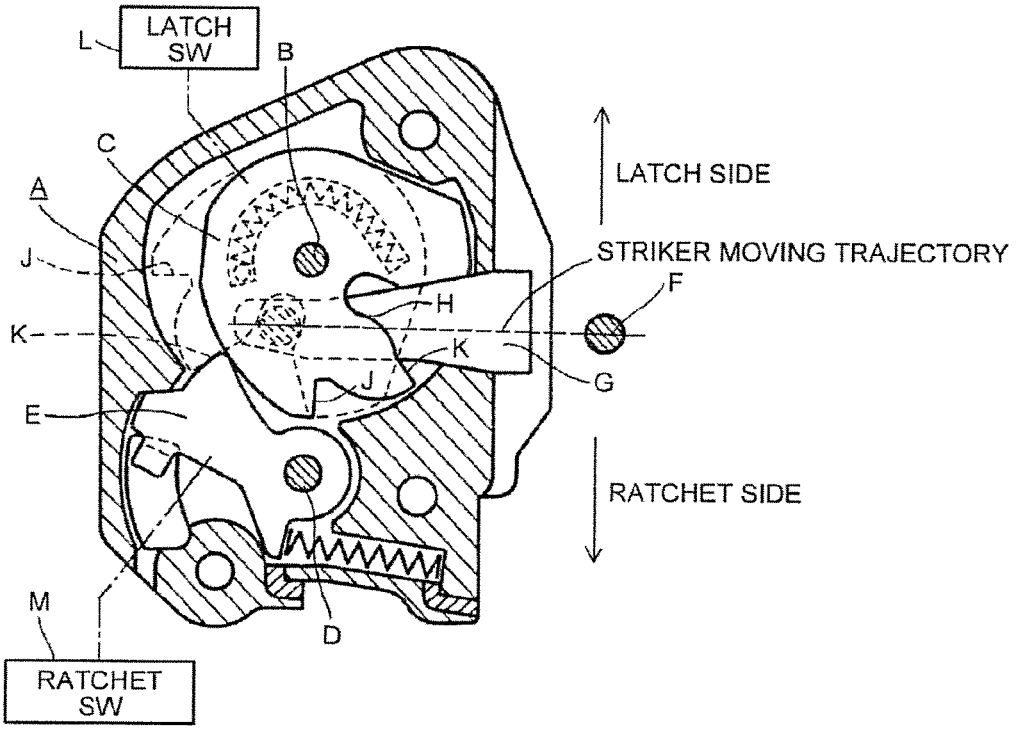
FIG.7 Related Art
FIG. 7 is a schematic diagram of a conventional vehicle door latch device.

The above described latch unit includes, similarly to the conventional example illustrated in FIG. 7, an arrangement structure called "reaction force halving structure". The latch 12 (latch shaft 11) and the ratchet 14 (ratchet shaft 13) face each other across the advancement passage 16 of the striker 15 and are respectively arranged separately to an upper side (latch side) and a lower side (ratchet side) that are divided by the advancement passage 16 in FIG. 1. The advancement passage 16 according to this embodiment is zoned by a rear face side bulged portion 37 as illustrated in FIG. 3 and FIG. 4. The rear face side bulged portion 37 is configured as a portion bulged to a rear face side in the latch body 10. If a left-right direction on the plane of paper in FIG. 3 and FIG. 4 corresponds to a front-back direction of the latch body 10, the rear face side bulged portion 37 extends in the front-back direction of the latch body 10.

Figure 2:
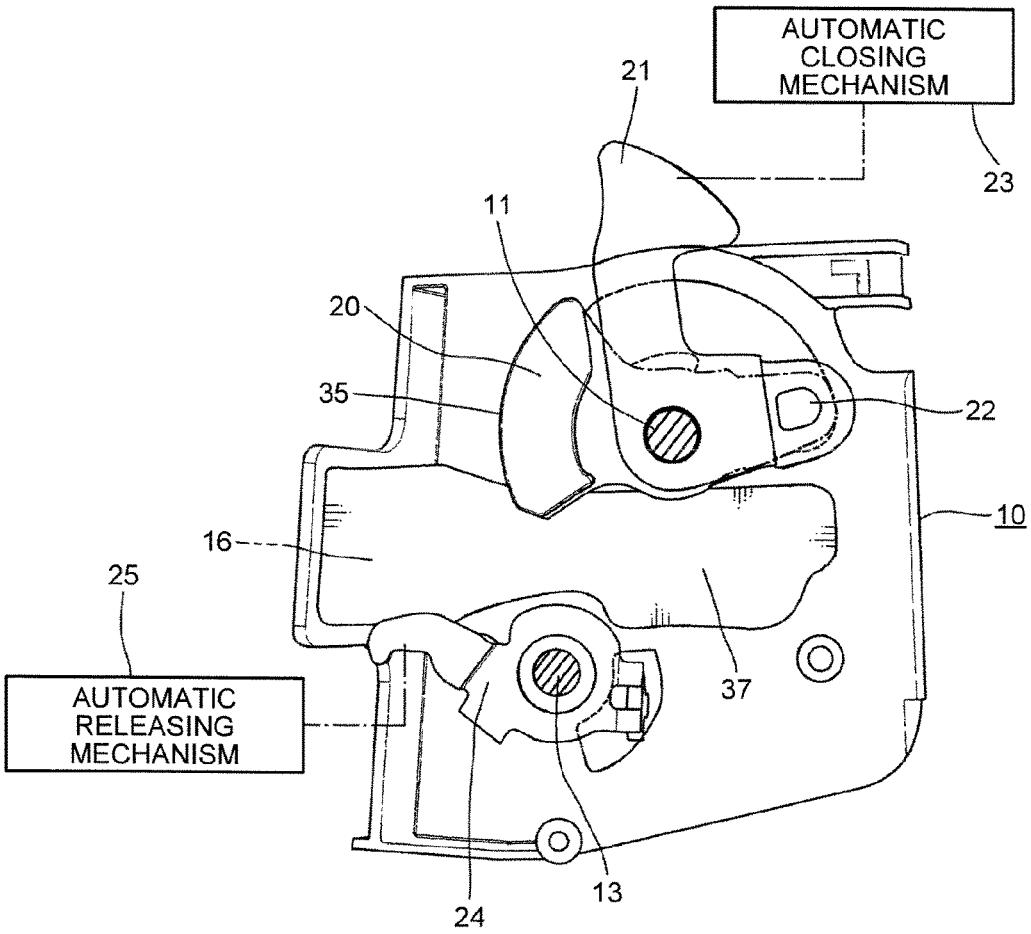
FIG. 2 is a rear view of the latch unit of FIG. 1 with a part thereof being omitted.
Figure 6:
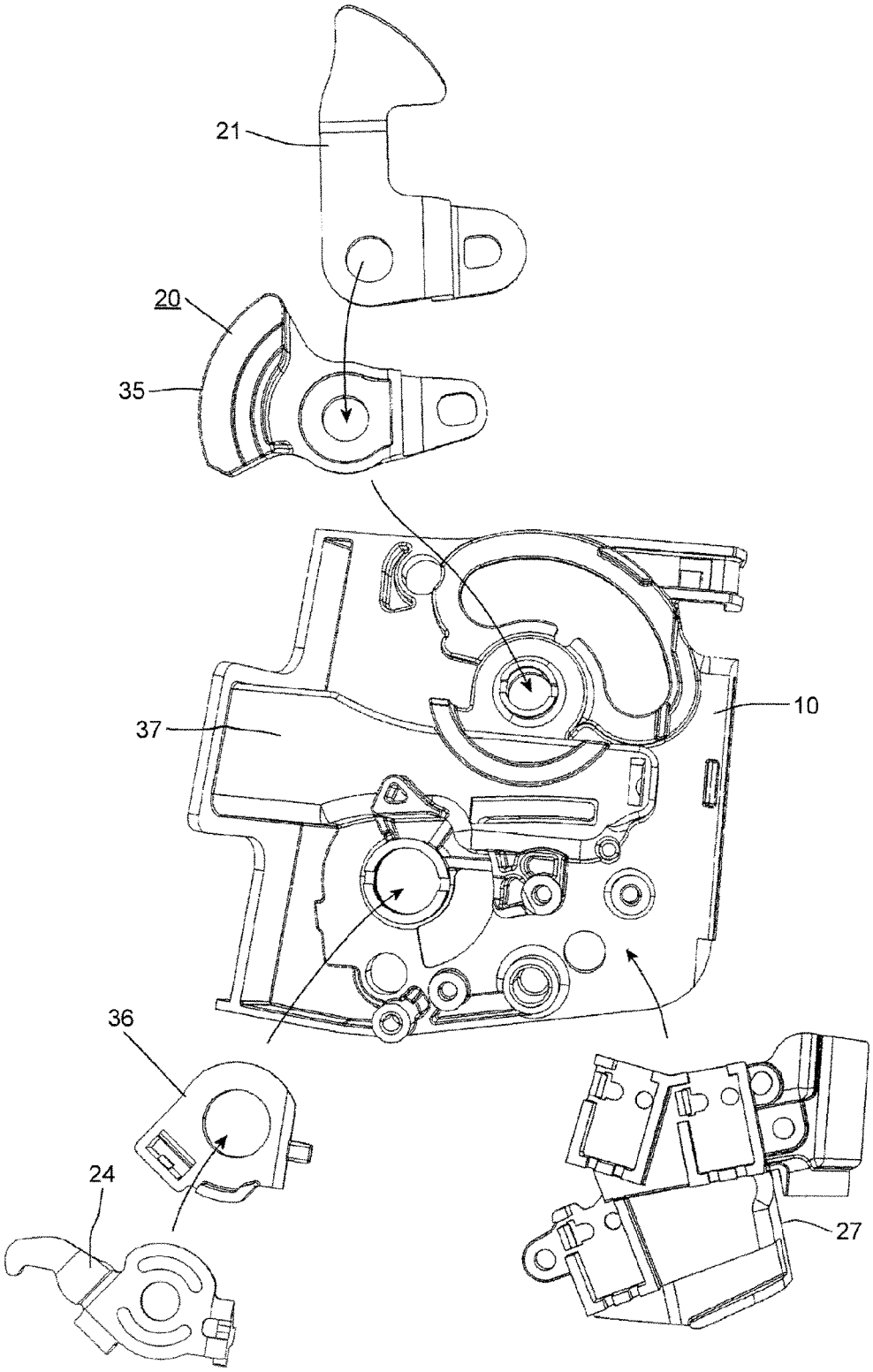
FIG. 6 is an exploded view of a rear face side of the latch unit.

FIG. 2 illustrates a rear face of the latch unit. At an end portion of the latch shaft 11, a latch switch lever 20 and an automatic closing lever 21 as illustrated in FIG. 6 are installed. The latch switch lever 20 and the automatic closing lever 21 rotate integrally and in association with the latch 12, and in this embodiment, the latch switch lever 20 and the automatic closing lever 21 are coupled to each other by a coupling pin 22 penetrating through the latch body 10 and associatively rotate about the latch shaft 11.

A conventionally well known motor-type automatic closing mechanism 23 is associatively coupled to the automatic closing lever 21. When the automatic closing lever 21 is rotated by a motor power of the automatic closing mechanism 23, the latch 12 at the half latch position is electrically rotated to the full latch position.

At an end portion of the ratchet shaft 13, a ratchet lever 24 that rotates in association with the ratchet 14 is provided. The ratchet lever 24 preferably is made of a metal plate, and is able to operate in association with the ratchet 14 by a part of the ratchet lever 24 being bent and engaged with the ratchet 14. The ratchet lever 24 is associatively coupled to an open handle (not illustrated) of a door. When the ratchet lever 24 is rotated by a door opening operation of the open handle, the ratchet 14 is rotated in a door opening direction (anticlockwise direction in FIG. 1) and is released from the engagement with the latch 12. When the ratchet 14 is released from the engagement with the latch 12, the door is brought into an openable state.

Further, a conventionally well known motor-type automatic releasing mechanism 25 is associatively coupled to the ratchet lever 24. The ratchet 14 is able to be released from the engagement with the latch 12 to bring the door into the openable state, also by a motor power of the automatic releasing mechanism 25. The above configuration is similar to that of a conventional latch unit.

Figure 5:
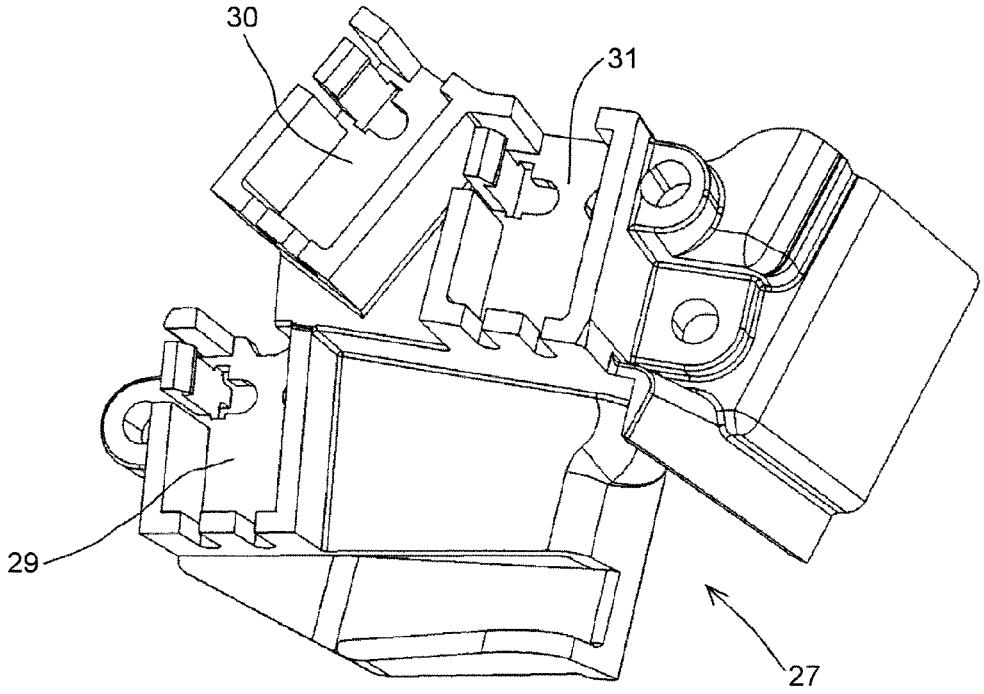
FIG. 5 is an enlarged perspective view of the switch case.

A switch assembly of this embodiment will be described. A switch assembly 26 illustrated in FIG. 4 includes a switch case 27 (see FIG. 3, FIG. 5, and FIG. 6), and a ratchet switch 32 and latch switches (a half latch switch 33 and a full latch switch 34) that are installed in this switch case 27.

The switch case 27 is made of, for example, a synthetic resin. The switch case 27 is fixed to the latch body 10 by a fixing means 28, such as a screw. Three switch accommodating portions 29, 30, and 31 are integrally formed with the switch case 27. The ratchet switch 32 is accommodated in the switch accommodating portion 29, the half latch switch 33 is accommodated in the switch accommodating portion 30, and the full latch switch 34 is accommodated in the switch accommodating portion 31. The switches 32, 33, and 34 are respectively accommodated in the switch accommodating portions 29, 30, and 31 beforehand, and the switch case 27 is fixed to the latch body 10 by the fixing means 28 with the switches 32, 33, and 34 having been respectively installed in the switch accommodating portions 29, 30, and 31. The switch case 27 is formed such that when the switch case 27 is fixed to the latch body 10, the ratchet switch 32 accommodated in the switch accommodating portion 29 is opposite to the ratchet shaft 13. Further, the switch case 27 is formed such that when the switch case 27 is fixed to the latch body 10, the switches 33 and 34 respectively accommodated in the switch accommodating portion 30 and switch accommodating portion 31 are opposite to the latch shaft 11 and are arranged along a rotation direction of the latch shaft 11.

The ratchet switch 32 detects a position of the ratchet 14. The latch switches detect positions of the latch 12, the half latch switch 33 detecting the half latch position of the latch 12 and the full latch switch 34 detecting the full latch position of the latch 12. The half latch switch 33 and full latch switch 34 respectively have movable terminals 38 and 39.

The half latch switch 33 and full latch switch 34 switch over from OFF to ON by coming into contact with a cam surface 35 (see FIG. 2 and FIG. 6) of the latch switch lever 20 that rotates in association with the latch 12. The cam surface 35 is formed on an outer peripheral surface of the latch switch lever 20. The positions of the latch 12 are detected by the cam surface 35 coming into contact with the movable terminal 38 and 39 of the latch switches 33 and 34 and the latch switches 33 and 34 switching over from OFF to ON, due to rotation of the latch switch lever 20. Further, the ratchet switch 32 switches over from OFF to ON by coming into contact with a ratchet switch lever 36 (see FIG. 6) that integrally rotates with the ratchet lever 24. The ratchet switch lever 36 is provided, together with the ratchet lever 24, at the end portion of the ratchet shaft 13. A position of the ratchet 14 is detected by the ratchet switch lever 36 coming into contact with the ratchet switch 32 and the ratchet switch 32 being switched over from OFF to ON.

The switch case 27 installed with the respective switches 32, 33, and 34 is arranged on a rear face of the latch body 10 on the ratchet side of a striker moving trajectory, as illustrated in FIG. 4. More preferably, the switch case 27 is arranged such that the switch case 27 does not overlap in the front-back direction with the rear face side bulged portion 37 of the latch body 10, the rear face side bulged portion 37 zoning the advancement passage 16. Accordingly, the switch case 27 is preferably arranged to come into contact with a lower face (face on the ratchet side) of the rear face side bulged portion 37. As a result, the size of the whole latch device with the switch case 27 being arranged in the latch device is able to be made compact. Further, the movable terminals 38 and 39 at distal ends of the half latch switch 33 that detects a half latch state (half latch position) of the latch 12 and the full latch switch 34 that detects a full latch state (full latch position) of the latch 12 are preferably arranged such that only the movable terminals 38 and 39 overlap in the front-back direction with the rear face side bulged portion 37 and contact with the cam surface 35 of the latch switch lever 20 at a position where the movable terminals 38 and 39 overlap with the rear face side bulged portion 37. That is, the switch assembly 26 preferably has the following configurations: a configuration in which a moving trajectory of the cam surface 35 illustrated by a virtual line 35*a* (arc-shaped curve) overlaps with the rear face side bulged portion 37 when the latch switch lever 20 rotates about the latch shaft 11; a configuration in which the latch switches 33 and 34 and the switch case 27 are arranged such that the movable terminals 38 and 39 of the latch switches 33 and 34 protrude from the switch case 27 and the protruded movable terminals 38 and 39 overlap with the rear face side bulged portion 37; and a configuration in which the movable terminals 38 and 39 of the latch switches 33 and 34 are arranged on the moving trajectory of the cam surface 35 illustrated by the virtual line 35*a*, such that the movable terminals 38 and 39 of the latch switches 33 and 34 arranged at the position where the movable terminals 38 and 39 overlap with the rear face side bulged portion 37 come into contact with the cam surface 35 of the latch switch lever 20.

As described above, since the switch assembly 26 according to this embodiment employs the concept of arranging the switch assembly 26 on only one side (ratchet side) of the striker moving trajectory, the ratchet switch 32, half latch switch 33, and full latch switch 34 are able to be manufactured by being installed in the one common switch case 27 beforehand, and thus the cost for the installation operation in the latch body 10 is able to reduced and suppression of the manufacturing cost is able to be expected.

Further, by causing the movable terminals 38 and 39 of the half latch switch 33 and full latch switch 34 to come into contact, at the position where the movable terminals 38 and 39 overlap with the rear face side bulged portion 37, with the cam surface 35 of the latch switch lever 20, a space (the switch accommodating portion 30 and switch accommodating portion 31) for installing the half latch switch 33 and full latch switch 34 is able to be rationally secured in the switch case 27 and the concept of arranging the switch assembly 26 only on the ratchet side of the striker moving trajectory is able to be implemented well.

The above described switch case 27 may be arranged on the latch side of the striker moving trajectory, instead of being configured to be arranged on the ratchet side of the striker moving trajectory.

According to the present invention, since a concept of arranging a switch assembly on only a ratchet side of a striker moving trajectory is employed, a ratchet switch, a half latch switch, and a full latch switch are able to be manufactured by being installed in one common switch case beforehand, workload for the installation in a latch body is able to reduced, and thus suppression of the manufacturing cost is able to be expected.

Further, by causing movable terminals of the half latch switch and full latch switch to come into contact, at a position where the movable terminals overlap with a rear face side bulged portion, with a cam surface of a latch switch lever, a space for installing the half latch switch and full latch switch is able to be rationally secured in the switch case and the concept of arranging the switch assembly on only one side (ratchet side) of the striker moving trajectory is able to be implemented smoothly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A switch assembly of a vehicle door latch device, the switch assembly comprising:

a first latch switch configured to detect a first position of a latch, the latch being pivotally supported by a latch shaft and engaged with a striker, the latch shaft being mounted on a latch body, the latch body including an advancement passage into which the striker relatively advances;

a ratchet switch configured to detect a position of a ratchet, the ratchet being pivotally supported by a ratchet shaft and engaged with the latch to prevent reverse rotation of the latch, the ratchet shaft being mounted on the latch body; and one common switch case arranged on the latch body and accommodating the first latch switch and the ratchet switch, wherein the latch and the ratchet are arranged on a front face side of the latch body, the latch shaft is disposed on a first side of a striker moving trajectory of the striker, and the ratchet shaft and the common switch case are disposed on a second side of the striker moving trajectory opposite to the first side.

2. The switch assembly of the vehicle door latch device according to claim 1, wherein the one common switch case is configured to not overlap with a back face side bulged portion of the latch body.

3. The switch assembly of the vehicle door latch device according to claim 1, wherein the first latch switch is a half latch switch and the first position is a half latch position of the latch, the switch assembly further comprises a second latch switch configured to detect a full latch position of the latch, and the one common switch case accommodates the first latch switch, the second latch switch, and the ratchet switch.

4. The switch assembly of the vehicle door latch device according to claim 1, wherein the first latch switch is a full latch switch and the first position is a full latch position of the latch, the switch assembly further comprises a second latch switch configured to detect a half latch position of the latch, and the one common switch case accommodates the first latch switch, the second latch switch, and the ratchet switch.

* * * * *